US009027799B2

(12) United States Patent
Hanai et al.

(10) Patent No.: US 9,027,799 B2
(45) Date of Patent: May 12, 2015

(54) AEROSOL CONTAINER FOR DISPENSING PLURAL KINDS OF LIQUIDS

(75) Inventors: Nobuyuki Hanai, Kawagoe (JP); Ken Ogata, Kawagoe (JP)

(73) Assignee: Toyo Aerosol Industry Co., Ltd., Tokyo (JP)

( * ) Notice: Subject to any disclaimer, the term of this patent is extended or adjusted under 35 U.S.C. 154(b) by 0 days.

(21) Appl. No.: 13/810,712

(22) PCT Filed: Jul. 20, 2010

(86) PCT No.: PCT/JP2010/062154

§ 371 (c)(1),
(2), (4) Date: Jan. 17, 2013

(87) PCT Pub. No.: WO2012/011162

PCT Pub. Date: Jan. 26, 2012

(65) Prior Publication Data

US 2013/0112707 A1 May 9, 2013

(51) Int. Cl.

| | |
|---|---|
| ***B65D 83/14*** | (2006.01) |
| ***B65D 83/68*** | (2006.01) |
| ***B65D 83/38*** | (2006.01) |

(52) U.S. Cl.

CPC ..... *B65D 83/68* (2013.01); *B65D 83/38* (2013.01)

(58) Field of Classification Search

CPC ..... B65D 83/38; B65D 83/54; B65D 83/62; B65D 83/68

USPC ..... 222/95, 105, 635, 94, 386.5, 136, 137, 222/402.1, 402.24

See application file for complete search history.

(56) References Cited

U.S. PATENT DOCUMENTS

| | | | | |
|---|---|---|---|---|
| 2,818,202 | A * | 12/1957 | Abplanalp | 222/402.24 |
| 3,092,107 | A * | 6/1963 | Froot | 604/140 |
| 3,176,890 | A * | 4/1965 | Potapenko et al. | 222/402.2 |
| 5,400,920 | A * | 3/1995 | Barnhart | 222/1 |
| 5,901,883 | A * | 5/1999 | Ritsche | 222/137 |
| 5,957,333 | A * | 9/1999 | Losenno et al. | 222/95 |
| 6,736,288 | B1 * | 5/2004 | Green | 222/94 |
| 7,748,572 | B2 * | 7/2010 | Althoff et al. | 222/153.11 |
| 8,434,648 | B2 * | 5/2013 | Marie et al. | 222/402.1 |
| 8,523,023 | B1 * | 9/2013 | Coroneos | 222/402.1 |
| 8,561,840 | B2 * | 10/2013 | Greer et al. | 222/1 |

(Continued)

*Primary Examiner* — Paul R Durand
*Assistant Examiner* — Charles P Cheyney
(74) *Attorney, Agent, or Firm* — Florek & Endres PLLC

(57) ABSTRACT

A mounting member fitted and mounted on an open head portion of an aerosol container 11 having an inner diameter of 1 inch is formed with two valve housing mounting portions. The mounting member is fitted and mounted with the middle portion of this mounting member being located at a bead 12 of the opening head portion of the aerosol container 11 in such a manner that the upper portions of aerosol valves project upwardly from the opening head portion. A cover 19 covering the outside of the mounting member is crimped to the outside of the bead 12 in a manner to hold down a stem gasket and two aerosol valves are provided in the inch can 11. A reinforcing cover member which holds down the stem gasket and prevents deformation of the cover is provided between the mounting member and the cover 19 to thereby accurately prevent deformation due to internal pressure applied to a top ceiling of the cover and leakage from the stem gasket. An aerosol device for dispensing plural kinds of liquids in which two aerosol valves for dispensing and injecting contents liquids are disposed in a standard aerosol container with a bead having an inner diameter of 1 inch can thereby be provided.

5 Claims, 11 Drawing Sheets

(56) References Cited

U.S. PATENT DOCUMENTS 8,602,272 B2 * 12/2013 Burel et al. ..... 222/402.2
2002/0074357 A1 * 6/2002 Karr et al. ..... 222/190
2009/0008584 A1 * 1/2009 Fontela et al. ..... 251/118
2011/0315712 A1 * 12/2011 Chiba et al. ..... 222/137

* cited by examiner

AEROSOL CONTAINER FOR DISPENSING PLURAL KINDS OF LIQUIDS

This application is a U.S. National Stage filing under 35 U.S.C. §371 of International Application No. PCT/JP2010/062154, filed Jul. 20, 2010.

TECHNICAL FIELD

This invention relates to an aerosol container for dispensing plural kinds of liquids using an aerosol container having an inner diameter of 1 inch according to which plural kinds of liquids can be dispensed and injected separately from independent aerosol valve systems.

BACKGROUND ART

There are various types of aerosol products filled with contents liquids and propellant. Among them, there are products according to which an excellent function can be obtained by mixing plural kinds of contents. Such products include, for example, coating, adherent, hair dyeing agent and pharmaceuticals.

Many of such substances which must be mixed before use cause chemical reaction such as hardening and oxidation by mixing and, therefore, when mixing is performed in an aerosol valve, there occurs a case wherein the aerosol valve cannot be reused due to hardening or the like cause. In such a case, therefore, it is preferable to dispense and inject such contents outside instead of mixing them inside of the aerosol valve.

For this reason, in the two liquid dispensing aerosol device disclosed in Patent Literature 1 below, for example, different contents liquids are filled in two different inner bags by gas pressure, two passages respectively communicating with the inner bags are formed in a single aerosol valve and these two contents liquids are dispensed and injected from the valve stem.

In the aerosol valve device for dispensing plural kinds of liquid disclosed in Patent Literature 2 below, a plurality of stem operation apertures are formed in a mounting cup mounted on an open head portion of an aerosol container, an aerosol valve is mounted on each of the stem operation apertures, an inner container is housed in an outer container and liquid to be treated contained in each of the inner container and the outer container is dispensed from the respective aerosol valves.

In the aerosol device disclosed in Patent Literature 3 below, two aerosol containers are connected together and a common injection button is attached to each valve stem provided in a mounting cup at the top end portion of each container and liquid to be treated in the two aerosol containers are separately injected up to the injection button, On the other hand, an aerosol container which is generally used as a standard type aerosol container of such aerosol product, there is one called "one inch can" which has an inner diameter of 1 inch , has a bead formed along the outer periphery of its open head portion, and is closed by fixing a mounting cup by, e.g., caulking.

PRIOR ART LITERATURE

Patent Literature 1: Japanese Patent Application Laid-open Publication No. 2004-244109

Patent Literature 2: Japanese Patent Application Laid-open Publication No. 2002-193363

Patent Literature 3: Japanese Patent Application Laid-open Publication No. H10-86983

Problem to be Solved by the Invention

If it is intended to provide an aerosol product which can dispense and inject plural kinds of liquids filled in an aerosol container separately without mixing them by means of a so-called inch can which is often used as a standard type aerosol container, the aerosol device disclosed in Patent Literature 1 according to which two passages are formed in a single aerosol valve is compact and can be applied for such purpose but has the problem that it is necessary to form two passages in the aerosol valve which is made of a small piece of material and this makes the structure complicated and, moreover, when the stem is pushed down for injection, it is difficult to inject uniform amount of liquids from the two passages.

In the aerosol device disclosed in Patent Literature 2 according to which the two aerosol valves are mounted on the mounting cup, when the mounting cup is fixed to the bead along the outer periphery of the open head portion of the aerosol container, it is necessary to cause an expandable pawl located in a recess formed inside of the outer periphery of the mounting cup to expand outwardly. In the so-called inch can, however, space for receiving the pawl for clinching cannot be secured and, accordingly, the device of Patent Literature 2 cannot be applied.

Further, when two or more aerosol valves are provided, the area of the stem gasket becomes twice or more and, as a result, the area of top ceiling surface to which internal pressure is applied will also become larger. Hence, means must be provided for coping with such problem.

The present invention has been made for solving such problems of the prior art aerosol device. It is an object of the invention to provide an aerosol device for dispensing plural kinds of liquids which can dispose two or more aerosol valves in an aerosol container having a bead portion of an inner diameter of 1 inch which is frequently used as a standard type container and which can dispense and inject contents liquids separately without mixing.

It is also an object of the invention to provide an aerosol container for dispensing plural kinds of liquids which can prevent deformation due to increase in the area of a stem gasket portion caused by disposing two or more aerosol valves.

Means for Solving the Problems

For solving these problems, an aerosol device for dispensing plural kinds of liquids comprises: an aerosol container having an open head portion having an inner diameter of 1 inch and formed with a bead around the open head portion; a plurality of aerosol valves housed in the aerosol container each having a stem through which contents liquid of each of the aerosol valves is injected outside; a mounting member which is fittedly mounted on the open head portion with a middle portion of the mounting member being located at the bead of the open head portion; a plurality of valve housing mounting portions provided in the mounting member each being capable of mounting the aerosol valves; and a cover covering the outside of the mounting member, holding a stem gasket and being fixed on the outside of the bead through a seal gasket, said stems of the aerosol valves projecting outwardly through the cover.

An aerosol device can additionally comprise a reinforcing cover member provided between the mounting member and the cover for holding down the stem gasket and preventing deformation of the cover.

An aerosol device can additionally comprise holding means provided between the reinforcing cover member and the mounting member and being capable of holding the reinforcing cover member to the mounting member.

In an aerosol device, in addition to the structure defined above, a pair of the aerosol valves are provided, a top end projecting portion of a substantially elliptic cylinder shape having a pair of parallel flat side walls is formed in the top portion of the mounting member, and the reinforcing cover member is provided in a manner to cover the top end projecting portion.

In an aerosol device, in addition to the structure defined above, the reinforcing cover member has, in addition to the portion covering the top end projecting portion, a portion which covers a bottom portion of the mounting member.

In an aerosol device, in addition to the structure defined above, an aerosol propellant is filled in the aerosol container and an inner bag which can vary capacity of contents liquid filled therein is connected to each of the aerosol valves.

In this specification, contents liquids mean not only liquidus initial liquids which are filled in an aerosol container but also initial liquids in a state of jell, foam or cream.

Advantageous Results of the Invention

According to the aerosol device for dispensing plural kinds of liquids, the aerosol device comprises: an aerosol container having an open head portion having an inner diameter of 1 inch and formed with a bead around the open head portion; a plurality of aerosol valves housed in the aerosol container each having a stem through which contents liquid of each of the aerosol valves is injected outside; a mounting member which is fittedly mounted on the open head portion with a middle portion of the mounting member being located at the bead of the open head portion; a plurality of valve housing mounting portions provided in the mounting member each being capable of mounting the aerosol valves; and a cover covering the outside of the mounting member, holding a stem gasket and being fixed on the outside of the bead through a seal gasket, said stems of the aerosol valves projecting outwardly through the cover. Since two or more valve housing mounting portions are formed in the mounting member fittedly mounted on the open head portion having an inner diameter of 1 inch and the aerosol valve is mounted in each of these valve housing mounting portions, sufficient space for mounting the aerosol valves can be secured as compared with the prior art mounting cup which clinches from the inside.

Further, since the mounting member is fittedly mounted with the middle portion of the mounting member being located at the bead of the open head portion, the upper portions of the aerosol valves project from the open head portion and the outside of the mounting member is covered with the cover which is fixed to the outside portion of the bead by caulking or the like in a manner to hold the stem gasket, two or more aerosol valves can be provided in an inch can.

By this arrangement, contents liquids can be dispensed and injected separately without mixing from two or more aerosol valves and uniform amount of contents liquids can be injected from each aerosol valve.

According to the aerosol device, the reinforcing cover member is provided between the mounting member and the cover for holding the stem gasket and preventing deformation of the cover. Since the reinforcing cover member is disposed on the outside of the stem gasket, deformation due to internal pressure applied to the top ceiling portion of the cover or leakage from the stem gasket can be accurately prevented.

By this arrangement, even in a case where the area of the gasket portion increases due to disposition of two or more aerosol valves, deformation and leakage can be effectively prevented.

According to the aerosol device, the holding means is provided between the reinforcing cover member and the mounting member and this holding member is capable of holding the reinforcing cover member to the mounting member. By providing the holding means such as a slit and a pawl which can engage with each other between the reinforcing cover member and the mounting member, the reinforcing member can be held on the mounting member in an assembled state. By this arrangement, the cover can be fixed by means of e.g., crimping in the assembled state of the aerosol valve whereby manufacturing and assembling of the aerosol device can be facilitated.

According to the aerosol device, a pair of the aerosol valves are provided, a top end projecting portion of a substantially elliptic cylinder shape having a pair of parallel flat side walls is formed in the top portion of the mounting member, and the reinforcing cover member is provided in a manner to cover the top end projecting portion. By forming the top end portion of a substantially elliptic shape having a pair of parallel flat side walls in the mounting member and covering it with the reinforcing cover member, positioning becomes easy because assembling is made on the basis the parallel flat side walls and, therefore, the assembling work can be made efficiently and the filling process for filling contents liquids into the aerosol container can also be made efficiently.

According to the aerosol device, the reinforcing cover member has, in addition to the portion covering the top end projecting portion, a portion which covers a bottom portion of the mounting member. By covering the entire mounting portion including the bottom portion in addition to the top end projecting portion of the mounting member, the top ceiling portion of the cover can be reinforced further accurately whereby deformation due to internal pressure and leakage of contents liquids can be prevented further accurately.

According to the aerosol device, the aerosol propellant is filled in the aerosol container and the inner bag which can vary capacity of contents liquid filled therein is connected to each of the aerosol valves. By this arrangement, two or more kinds of contents liquids can be dispensed and injected in the state in which contents liquids are separated from the inner bags and therefore contents liquids can be respectively injected without contacting the interior surface of the aerosol container.

EMBODIMENTS FOR CARRYING OUT THE INVENTION

Embodiments for carrying out the invention will now be described in detail.

Figure 1:
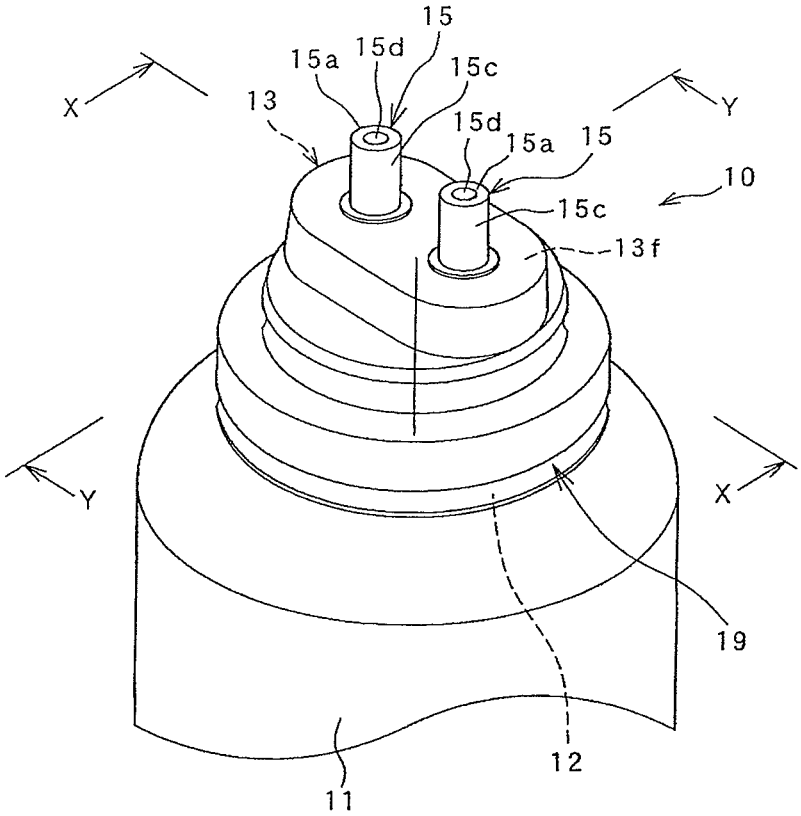
FIG. 1 is an outside perspective view of an embodiment of the aerosol device according to the invention.

In an embodiment of an aerosol device 10 for dispensing plural kinds of liquids according to the invention, as shown in FIG. 1, a pair of aerosol valves 15, 15 are provided in an aerosol container 11 which is an inch can having an inner diameter of 1 inch and having a bead 12 which is generally used as a standard can.

Figure 2:
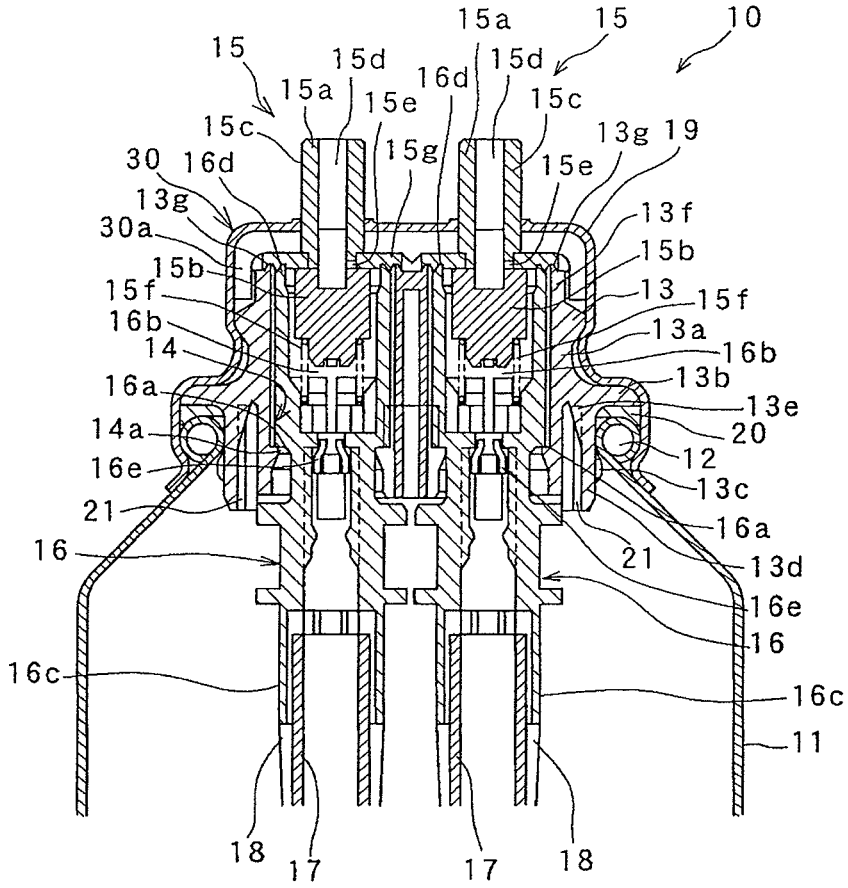
FIG. 2 is a vertical sectional view in the central portion of one embodiment of the aerosol device according to the invention (X-X section in FIG. 1).
Figure 3:
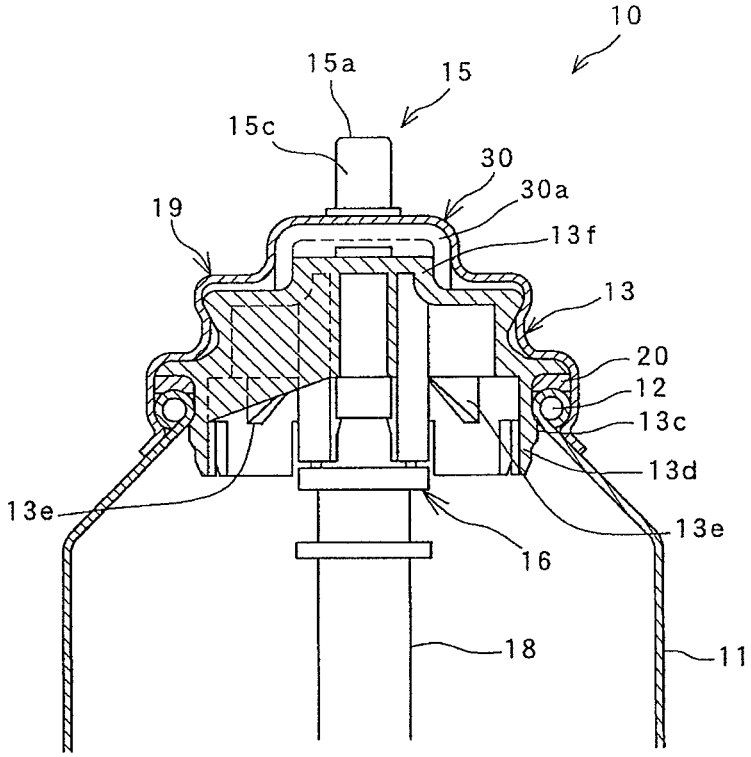
FIG. 3 is a vertical sectional view in the central portion of the embodiment of the aerosol device crossing FIG. 1 (Y-Y section in FIG. 1).
Figure 4B:
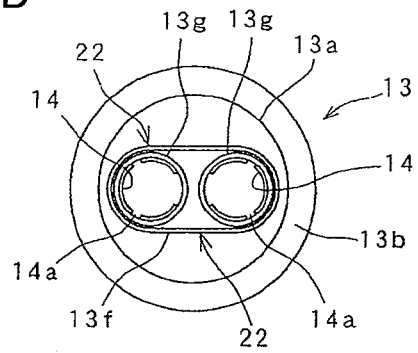
FIGS. 4(*a*)-(*d*) are a front view, a plan view, a bottom view and a side view of a mounting member of the aerosol device according to the invention.
Figure 4A:
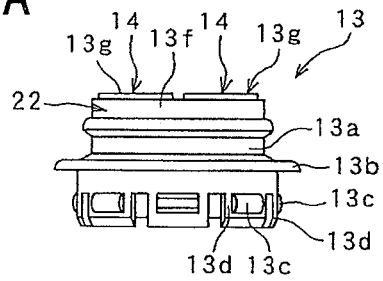
Figure 4D:
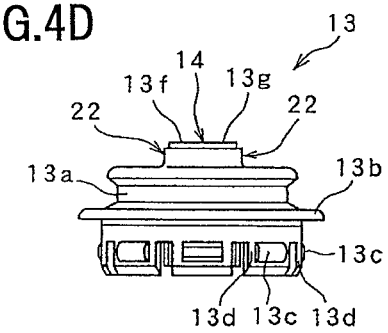
Figure 4C:
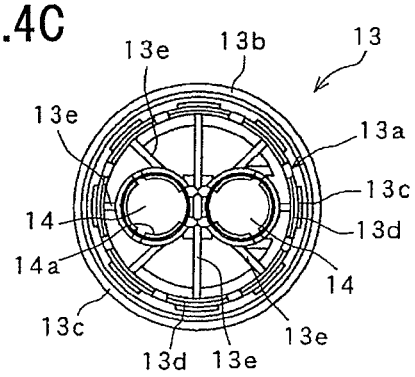
Figure 5B:
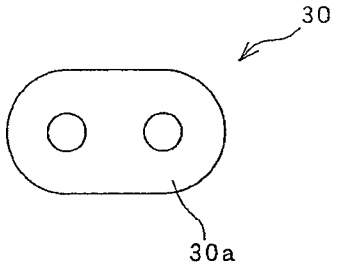
FIGS. 5(*a*)-(*d*) are a vertical sectional view in the central portion, a plan view, a bottom view and a side view of a reinforcing cover member of the embodiment of the aerosol device.
Figure 5A:
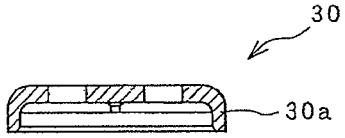
Figure 5D:
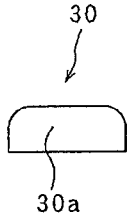
Figure 5C:
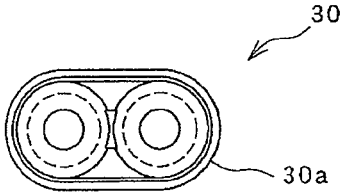
Figure 6:
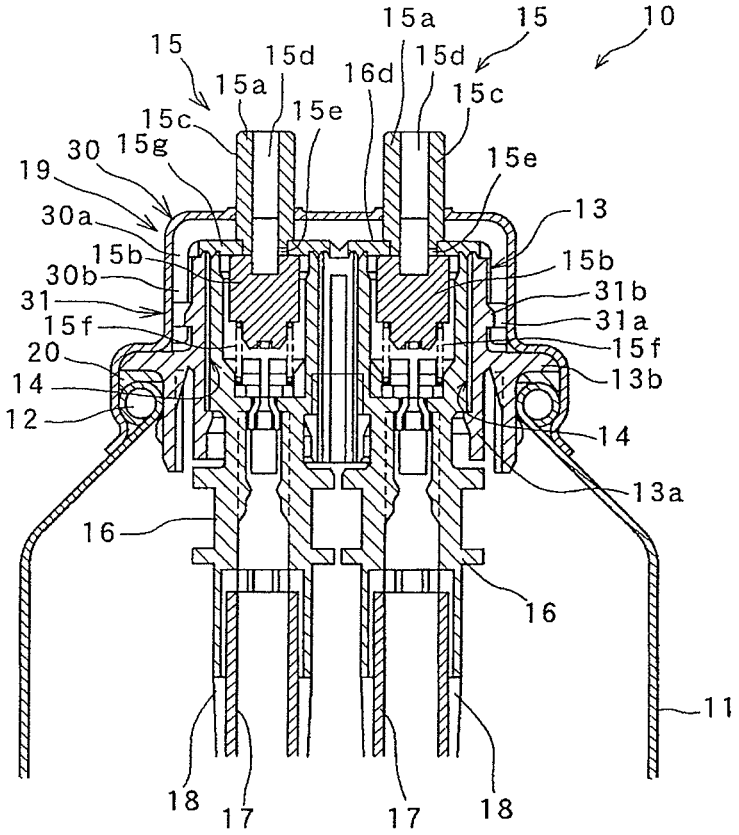
FIG. 6 is a vertical sectional view in the central portion of another embodiment of the aerosol device according to the invention corresponding to X-X section of FIG. 1.
Figure 7:
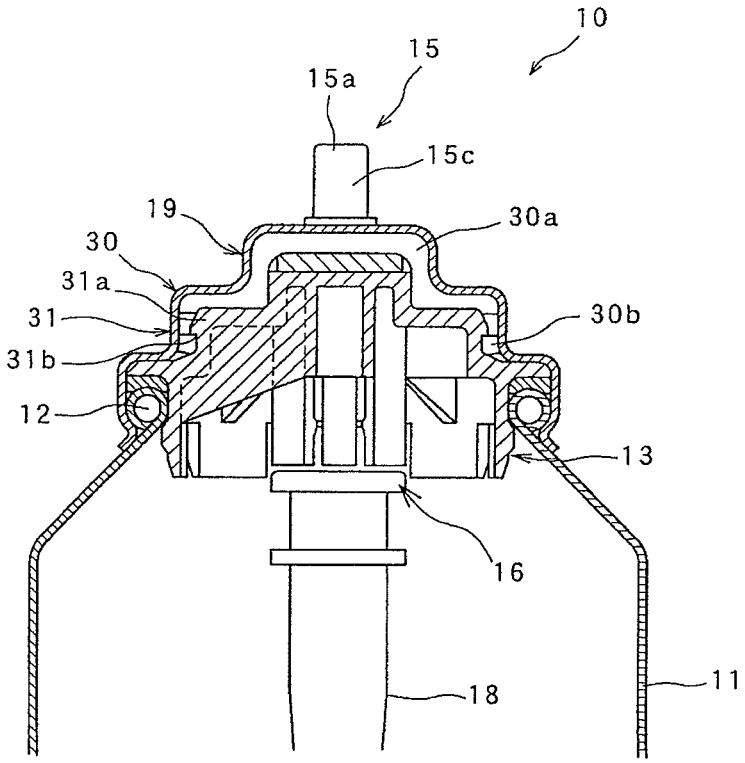
FIG. 7 is a vertical sectional view in the central portion of the other embodiment of the aerosol device according to the invention crossing FIG. 6 corresponding to Y-Y section of FIG. 1.
Figure 8B:
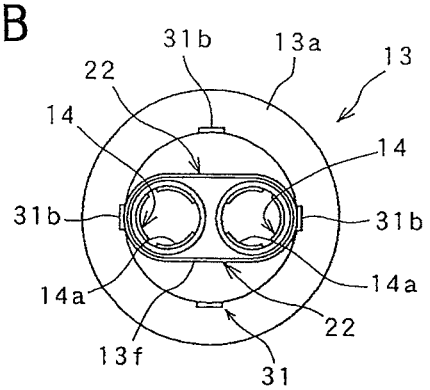
FIGS. 8(*a*)-(*d*) are a front view, a plan view, a bottom view and a side view of a mounting member of the other embodiment of the aerosol device.
Figure 8A:
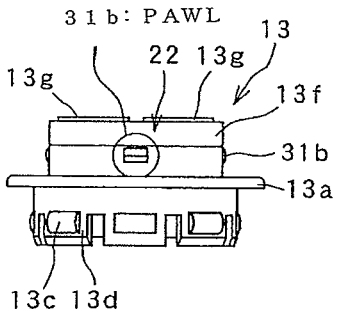
Figure 8D:
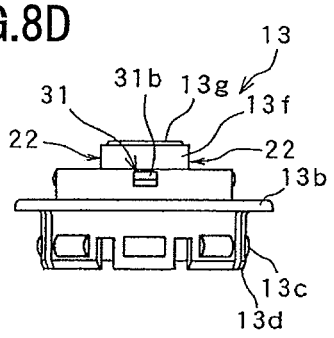
Figure 8C:
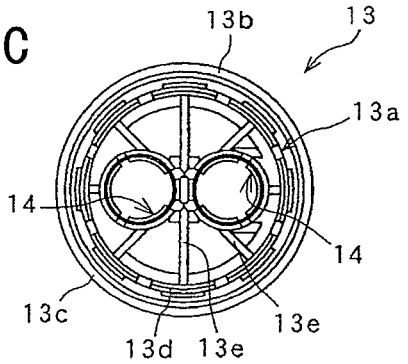
Figure 9B:
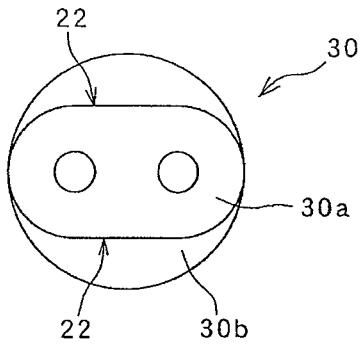
FIGS. 9(*a*)-(*d*) are a vertical sectional view in the central portion, a plan view, a bottom view and a side view of a reinforcing cover member of the embodiment of the aerosol device.
Figure 9A:
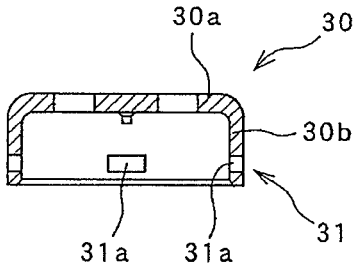
Figure 9D:
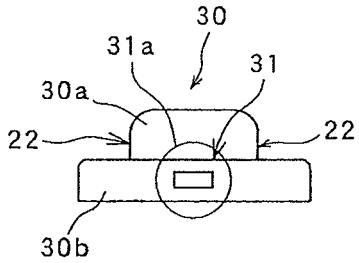
Figure 9C:
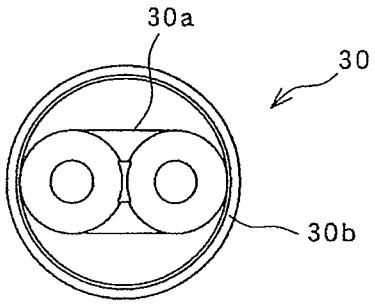
Figure 10B:
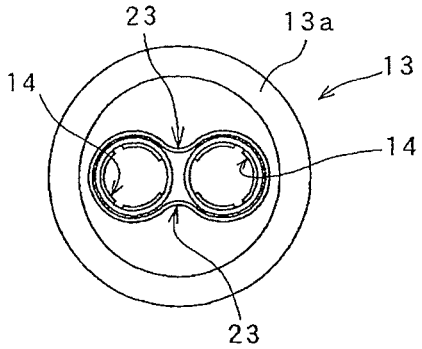
FIGS. 10(*a*)-(*d*) are a front view and a plan view of a mounting member and a vertical sectional view in the central portion and a plan view of a reinforcing cover member of another embodiment of the aerosol device according to the invention.
Figure 10A:
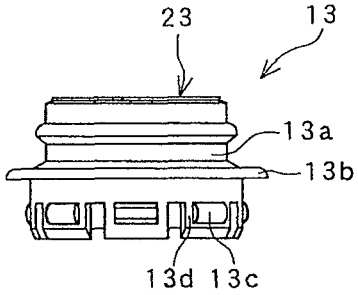
Figure 10D:
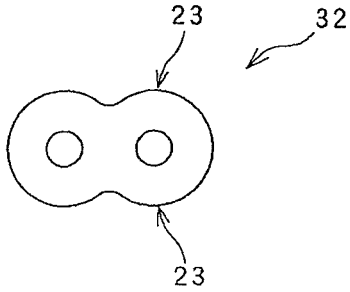
Figure 10C:
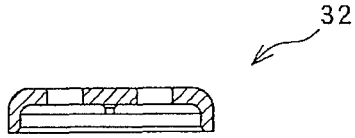
Figure 11B:
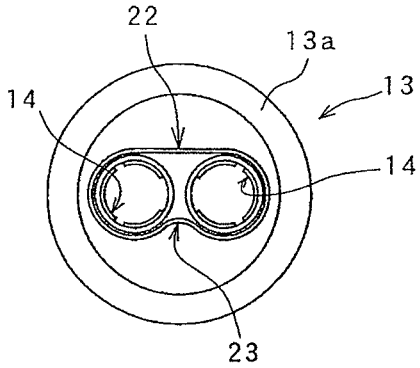
FIGS. 11(*a*)-(*d*) are a front view and a plan view of a mounting member and a vertical sectional view in the central portion and a plan view of a reinforcing cover member of still another embodiment of the aerosol device according to the invention.
Figure 11A:
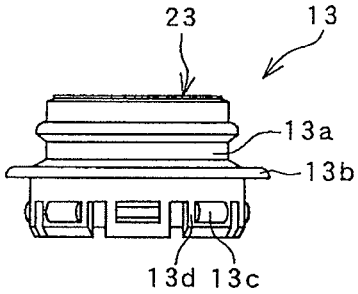
Figure 11D:
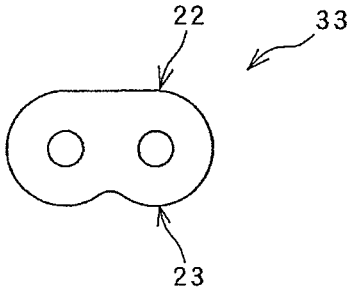
Figure 11C:
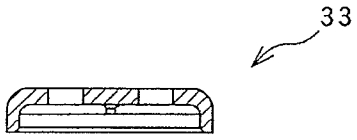

In this aerosol device 10 for dispensing plural kinds of liquids, as shown in FIGS. 2 and 3, a mounting member 13 made of synthetic resin is fitted and mounted on the bead 12 of the aerosol container 11. A pair of valve housing mounting portions 14, 14 are formed in the mounting member 13 and the aerosol valves 15, 15 are mounted on the valve housing mounting portions 14, 14.

This mounting member 13 has, as shown in FIGS. 4(*a*)-(*d*), a mounting member main body 13*a* of a generally cylindrical shape. A flange portion 13*b* is formed in the outer periphery of the middle portion of the mounting member main body 13*b* and this flange portion 13*b* abuts against the upper portion of the bead 12. Eight engaging portions 13*d* each formed with an engaging projection 13*c* which is engaged with the inner peripheral surface of the bead 12 are provided at an equal circumferential interval below the flange portion 13*b*. The upper end portion of each of the engaging portions 13*d* is connected to the mounting member main body 13*a* with radial ribs 13*e* which extend radially and the engaging portions 13*d* can be elastically deformed in a buffer space formed between the engaging portions 13*d* and the mounting member main body 13*a* and, therefore, by pushing down the mounting member 13, the mounting member 13 can be fitted and mounted on the bead 12.

In the mounting member main body 13*a* fitted and mounted on the bead 12 of the aerosol container 11, the valve housing mounting portions 14, 14 which are parallel in vertical direction and each of which has a small cylindrical shape are provided on both sides of the central axis of mounting member 13. The valve housing mounting portions 14, 14 are supported in the mounting member main body 13*a* through the radial ribs 13*e* which support the engaging portions 13*d*. The upper end portions of the valve housing mounting portions 14, 14 are located in a top end projecting portion 13*f* of a substantially elliptic cylinder shape which projects at the top of the mounting member main body 13*a* and has a pair of parallel flat side walls 22, 22 and a pair of semicircle walls at the ends of the flat side walls.

In the inner periphery in the middle portion of the valve housing mounting portions 14, 14, there are formed engaging pawls 14*a* for engaging with the valve housing 16, 16 of the aerosol valves 15, 15.

The valve housings 16, 16 of the aerosol valves 15, 15 mounted on the pair of valve housing mounting portions 14, 14 are substantially of a cylindrical shape and formed in the outer periphery in the middle portion thereof with engaging stepped portions 16*a*. By engaging of the engaging pawls 14*a* of the valve housing mounting portions 14 with the engaging stepped portions 16*a*, the valve housings 16, 16 are engaged with and fixed to the valve housing mounting portions 14, 14.

Each of these valve housings 16 is formed in its upper portion with a valve chamber 16*b* and, in its lower portion, with a tube mounting portion 16*c*. A dip tube 17 is mounted on the tube mounting portion 16*c*. An inner bag 17 which can change its capacity by pressure applied by a propellant is also attached to the tube mounting portion 16*c*.

In each of the aerosol valves 15, 15 mounted on the valve chambers 16*b*, a stem 15*a* is formed integrally with a stem body 15*b* and a stem projecting portion 15*c*. An injection opening 15*d* is formed in the central portion of the stem projecting portion 15*c* and orifices 15*e* communicating with the valve chamber 16*b* are formed on opposite sides of the stem projecting portion 15*c* at positions adjacent to the upper surface of the stem body 15*b*. The stem 15*a* and the stem body 15*b* which is integral with the stem 15*a* are urged upwardly by a spring 15*f* provided at the bottom of the valve chamber 16*b*. Each of the stems 15*a* penetrates a central opening of an annular stem gasket 15*g* which is opened and closed as a valve. In a state in which the stem 15*a* is urged to the upper end which is an ordinary position of the stem 15*a*, the orifices 15*e* opening on the opposite sides of the stem 15*a* are closed and communication between the valve chamber 16*b* and the injection opening 15*d* thereby is interrupted. When the stem 15*a* is pushed down, the stem gasket 15*g* is bent to open the orifices 15*e* and thereby cause the valve chamber 16*b* to communicate with the injection opening 15*d* of the stem 15*a*.

The stem gasket 15*g* which is opened and closed as a valve extends over both the upper surface of the valve housing 16 and the upper surface of the top end projecting portion 13*f* of the mounting member 13. Seal points 16*d* and 13*g* in the form of annular concentric projections are formed on the upper surface of the valve housing 16 and the upper surface of the top end projecting portion 13*f* of the mounting member 13 so that, when the stem gasket 15*g* is pressed from above, surface pressure is increased and seal thereby is realized. In this embodiment, an integral stem gasket 15*g* is used in correspondence to the two stems 15*a*, 15*a* and this gasket 15*g* is formed to correspond to the shape of the upper surface of the generally elliptic cylinder shape of the top end projecting portion 13*f*.

A cover 19 made of a metallic plate such as an aluminum plate is provided in a manner to cover the mounting member 13 and the valve housings 16, 16. The two stems 15*a*, 15*a* project through the cover 19. The cover 19 holds down the stem gasket 15*g* and the lower end peripheral portion of the cover 19 is fixed to the outside of the bead 12 of the aerosol container 11.

This cover 19 has such a shape that the uppermost portion of the cover 19 covers the outside of the top end projecting portion 13*f* of the generally elliptic shape. A cylindrical portion of a small diameter, a cylindrical portion of a large diameter and a crimp portion are formed continuously below the uppermost portion. When the cover 19 is fixed to the bead 12, a seal gasket is disposed between the upper surface of the bead 12 and the flange portion 13*b* of the mounting member 13 and the cover 19 is crimped. Sealing property of the aerosol container 11 thereby is improved.

In this aerosol device 10 for dispensing plural kinds of liquids, for performing contents filling operation smoothly and adjusting an amount of flow of injected liquid, a lower valve chamber 16*e* is provided below each of the valve chambers 16*b* and a poppet valve 21 is mounted on the lower valve chamber 16*e*. When contents liquids are filled, the poppet valve 21 is brought to its lower position for forming a flow path around the poppet valve 21 and thereby enabling filling of contents liquids in a short period of time. When the aerosol device is used after filling of contents liquids, the poppet valve 21 is pushed up by contents liquids and held in its upper position for controlling the amount of flow of injection in the central flow path.

Therefore, by mounting of the poppet valves 21, it is not necessary to control the flow amount of injection at the orifices 15*e* of the stem 15*a* and a large opening which does not hamper filling of contents liquids may be formed.

In the aerosol device of this embodiment, the single stem gasket 15*g* corresponding to the two stems 15*a*, 15*a* is held down by the cover 19. Since, however, the area of the stem gasket 15*g* is increased in correspondence to the area of the top end projecting portion 13*f* as compared with a stem gasket corresponding to the prior art single stem and the area of the aerosol container 11 to which internal pressure of the aerosol container 11 is applied is also increased, a reinforcing cover member 30 made of synthetic resin is provided for holding down the stem gasket 15*g* and preventing deformation of the cover 19.

This reinforcing cover member 30 includes, as shown in FIG. 5(*a*)-(*d*), a cover main body 30*a* which covers the outside surface of the top end projecting portion 13*f* of the mounting member 13 and holds down the stem gasket 15*g* and prevents deformation of the cover 19 by rigidity of synthetic resin.

By holding the cover 19 by means of the reinforcing cover member 30, increase in the pressure receiving area can be sufficiently coped with by using a relatively simple part.

As the reinforcing cover member 30, as shown in FIGS. 6-9 which show another embodiment of the aerosol device for dispensing plural kinds of liquids according to the invention, the reinforcing cover member 30 may be constructed as a member which has, in addition to a cover main body 30*a* covering the outside surface of the top end projecting portion 13*f* of the mounting member 13, a bottom portion 30*b* which covers the mounting member main body 13*a* of the mounting member 13 which is formed continuously below the cover main body 30*a*. By forming this bottom portion 30*b*, it becomes possible to provide holding means 31 for holding the reinforcing cover member 30 to the mounting member 13. As this holding means 31, for example, four laterally elongated slits 31*a* constituting the holding means 31 may be formed in the peripheral side walls of the bottom portion 30*b* and pawls 31*b* projecting outwardly may be formed at corresponding positions of the mounting member main body 31 of the mounting member 13.

By holding the assembled state by engaging the slits 31*a* and the pawls 31*b* of the holding means 30 provided between the reinforcing cover member 30 and the mounting member 13, the aerosol valve 15 can be held in an assembled state even before covering the outside of the aerosol valve with the cover 19 and fixing the cover 19 to the bead 12 of the aerosol container 11. Therefore, manufacturing and assembling of the aerosol device can be facilitated and filling of a propellant before fixing can also be facilitated.

The structure of the aerosol device in other respects is the same as the structure of the previously described embodiment.

In a case where the cover 19 can prevent deforming by virtue of its material, thickness of plate or the like reason, the reinforcing cover member 30 may be omitted and the number of the component parts thereby can be reduced.

In the above described embodiments, the flange portion 13*b* is formed in the mounting member 13 and this flange portion 13*b* abuts against the bead 12 of the aerosol container 11. Alternatively, the flange portion may be omitted and the middle portion of the mounting member 13 may be positioned at the bead 12 in such a manner that a part of the mounting member 13 projects upwardly to cover a part of the cover 19 and is fixed to the bead 12. By this arrangement, the shape of the mounting member 13 will be simplified and production of a mold will become easy.

Description will now be made about a process of assembling of the aerosol device 10 for dispensing plural kinds of liquids and about filling of contents liquid and a propellant.

In the mounting member 13, the seal gasket 20 for sealing with the bead 12 is attached on the lower surface of the flange portion 13*b* of the mounting member main body 13*a*.

In the valve housing 16, the poppet valve 21 is mounted in the lower valve chamber 16*e* with a gap being formed around the poppet valve 21 and then the dip tube 17 is connected to the tube mounting portion 16*c* at the lower end of the valve housing 16 and the inner bag 18 is mounted in a manner to cover the dip tube 17 and fixed to the outside surface of the dip tube mounting portion 16*c*.

Then, the valve housing 16 to which the dip tube 17 and the inner bag 18 are fixed is mounted on the valve housing mounting portion 14 of the mounting member 13 from the lower portion of the valve housing 16 and is fixed at a predetermined position by engaging the engaging stepped portion 16*a* with the engaging pawl 14*a*.

In the aerosol valve 15, the stem 15*a* and the spring 15*f* are assembled and then the stem gasket 15*g* is mounted on the aerosol valve 15 with the stem 15*a* projecting through the stem gasket 15*g*.

Then, the aerosol valve 15 assembled in the above described manner is mounted on the valve chamber 16*b* of the valve housing 16 in such a manner that the stem gasket 15*g* is positioned on the upper surface of the mounting member 13 and the valve housing 16.

In the above described manner, a pair of the aerosol valves 15, 15 are mounted on the mounting member 13 via the valve housings 16, 16 with the stem gasket 15*g* disposed in position. Then, the reinforcing cover member 30 is provided in a manner to hold down the stem gasket 15*g*. Further, the outside surface of the reinforcing cover member 30 is covered with the cover 19 and the mounting member 13 and the cover 19 are fixed whereby the stem gasket 15*g* is pressed by the mounting member 13 and the seal points 13*g*, 16*d* of the valve housing 16 and the aerosol valves 15, 15 are brought to a closed state.

In the state in which the mounting member 13 and the valve housing 16 are covered with the cover 19, the inner bags 18, 18 are inserted into the open head portion of the aerosol container 11 and the seal gasket 20 is disposed on the bead 12 under the lower surface of the flange portion 13*b*.

In this state, the engaging projections 13*c* of the engaging portions 13*d* of the mounting member 13 mounted from the open head portion are not in an engaged state and a gap is formed between the bead 12 of the aerosol container 11 and the mounting member 13. Therefore, the aerosol container 11 is in communication with the outside.

In this state, a propellant is injected into the aerosol container 11.

Filling of the propellant is performed, in the same manner as in the prior art device, by disposing a propellanet filling head around the cover 19, filling the propellant such as nitrogen gas into the aerosol container 11 through the gap between the bead 12 of the aerosol container 11 and the mounting member 13, pushing down the mounting member 13 upon completion of filling to bring the engaging projections 13*c* of the projecting portions 13*d* into engaged state and, after the mounting member 13 is fitted and mounted, crimping the crimp portion at the lower outer periphery of the cover 19 to the outer periphery of the bead 12.

In the state in which the cover 19 is crimped, the seal gasket 20 at the lower surface of the flange portion 13*b* of the mounting member 13 is pressed onto the upper surface of the bead 12 to close the aerosol container 11 whereby filing of the propellant and assembly of the component parts of the aerosol device 10 are completed.

Then, contents liquids of different kinds are separately filled into the inner bags 18, 18 through the stems 15*a*, 15*a*.

Since in the aerosol container 11 which is different from the prior art aerosol container, the two stems 15*a*, 15*a* are provided on opposite sides of the central axis and different contents liquids are filled in these stems, it is necessary in the filling process to position the aerosol container 11 and contents liquids must be filled in the predetermined stems 15*a*, 15*a*. Since the top end projecting portion 13*f* of the mounting member 13 has a substantially elliptical shape having parallel flat side walls 22, 22, positioning of the stems 15*a*, 15*a* in forward and rearward directions and left and right directions can be made easily by utilizing the parallel flat side wall 22, 22 and, by conducting filling in the stems 15*a*, 15*a* by maintaining this position, different contents liquids can be filled in the respective inner bags 18, 18 separately.

By forming the top end projecting portion 13*f* of the mounting member 13 in the shape of the substantially elliptical shape having parallel fat side walls 22, 22 and utilizing these parallel flat side walls 22, 22 in positioning the aerosol container 11 in the filling process, the two stems 15*a*, 15*a* are positioned in forward and rearward direction and left and right directions. Alternatively, as shown in FIG. 10(*a*), the top end projecting portion 13*f* of the mounting member 13 may be formed in the shape of the FIG. 8 as viewed in a plan view with parallel curved side walls 23, 23 having a recess in the central portion on both sides. By utilizing these curved side walls 23, 23, in the same manner as in the case of the parallel flat side walls 22, 22, the two stems 13*a*, 13*a* can be positioned easily in forward and rearward directions and right and left directions. By conducting filling in the stems 15*a*, 15*a* while maintaining this state, different contents liquids can be filled in the inner bags 18, 18 separately and the stems can be held accurately by utilizing the central curved recesses.

In a case where this mounting member 13 is used, the reinforcing cover member 30 having a corresponding shape shown in FIG. 10(*d*) should be used.

In a case where positioning of the aerosol container 11 by utilizing the parallel flat side walls 22, 22 or the curved side walls 23, 23 on both sides, the two stems 15*a*, 15*a* can be positioned in forward and rearward directions and right and left direction but, in this case, positioning of the stems 15*a*, 15*a* upon discriminating these stems 15*a*, 15*a* from each other is not possible. In a case where, as shown in FIG. 11(*a*), the top end projecting portion 13*f* of the mounting member 13 is formed in the shape having a flat side wall 22 on one side and having a curved side wall 23 on the other side, by utilizing these flat side wall 22 and the curved side wall 23, the two stems 15*a*, 15*a* can be positioned not only in forward and rearward directions and right and left directions but also upon discriminating one stem 15*a* from the other stem 15*a*. By conducting filling in the predetermined stems 15*a*, 15*a* while maintaining this state, different contents liquids can be accurately filled in the inner bags 18 separately and the stems can be held accurately by utilizing the central recess of the curved wall 23.

In a case where this mounting member 13 is used, the reinforcing cover member 30 having a corresponding shape shown in FIG. 11(*d*) should be used.

According to the aerosol device 10 for dispensing plural kinds of liquids, two aerosol valves 15, 15 can be provided even in an inch can with a bead having an inner diameter of 1 inch and, by this arrangement, contents liquids can be dispensed and injected from the stems 15*a*, 15*a* of the respective aerosol valves 15, 15 to the outside in a separate state without mixing.

Thus, the aerosol device which can dispense and inject two different contents liquids outside can be composed of a one inch can and, therefore, the aerosol device can be manufactured at a reduced cost. It also becomes possible to inject each contents liquid with a uniform amount of injection from the two aerosol valves.

According to the aerosol device 10 for dispensing plural kinds of liquids, the middle portion of the mounting member 13 is located the bead 12 of the aerosol container 11 and the inserted portion of the stem 15*a* is located above the bead 12. By this arrangement, even if the two stems 15*a*, 15*a* of the two aerosol valves 15, 15 are disposed side by side, they can be fixed to the outside of the bead 12 by the cover 19 which covers the outside of the mounting member 13. Accordingly, it is not necessary to secure space for clinching in the inside as in the case of a prior art mounting cup and, therefore, two aerosol valves 15, 15 can be mounted on the aerosol container 11 without being restricted by the size of the bead 12 of a 1-inch can.

By disposing two aerosol valves 15, 15 in an inch can having 1-inch bead 12, the stem gasket 15*g* becomes of a size corresponding to the two stems 15*a*, 15*a* and the area of the top ceiling portion of the cover 19 which holds down the stem gasket 15*g* increases with the result that deformation tends to take place due to increase in the area receiving pressure by the propellant. Since, however, the reinforcing cover member 30 made of a synthetic resin is provided between the stem gasket 15*g* and the cover 19, the cover 19 can hold down the stem gasket 15*g* without likelihood of deformation.

By this arrangement, leakage due to deformation of the stem gasket 15*g* can be completely prevented.

According to the aerosol device 10 for dispensing plural kinds of liquids, the holding means 31 for holding the reinforcing cover member 30 to the mounting member 13 is provided between the reinforcing cover member 30 and the mounting member 13 and, for this purpose, the slits 31*a* are formed in the bottom portion 30*b* of the reinforcing cover member 30 and the pawls 31*b* are formed in the mounting member main body 13*a* of the mounting member 13. Accordingly, the reinforcing cover member 30 can be held to the mounting member 13 in an assembled state.

By this arrangement, the cover can cover the aerosol container 11 and can be fixed to the container 11 with the aerosol valves 15, 15 in an assembled state and, therefore, it is not necessary to assemble the device while holding down the stems 15*a*, 15*a* which are energized by the springs 15*f*, 15*f* and manufacturing and assembling works thereby can be facilitated.

According to the aerosol device 10 for dispensing plural kinds of liquids, a pair of the aerosol valves 15, 15 are provided, the top end projecting portion 13*f* of a substantially elliptical shape having parallel flat side walls 22, 22 is formed and the reinforcing cover member 30 covering this top end projecting portion 13*f* is fixed by crimping.

Accordingly, positioning is facilitated by conducting assembly on the basis of the parallel flat side wall 22, 22 of the top end projecting portion 13*f* and the assembly of the device thereby can be performed efficiently and the filling process for filling contents liquids in the aerosol container 11 can also be made efficiently with respect to each of the stems 15*a*, 15*a*. In the case of adopting the shape of the top end projecting portion 13*f* having the combination of the flat side wall 22 and the curved side wall 23, not only positioning of the two stems 15*a*, 15*a* but also discrimination of the two stems can be made.

According to the aerosol device 10 for dispensing plural liquids, the reinforcing cover member 30 has, in addition to the cover main body 30*a* covering the top end projecting portion 13*f*, the bottom portion 30*b* which covers the bottom portion of the mounting member 13. By covering the entire mounting member 13 including the bottom portion in addition to the top end projecting portion of the mounting member 13, the top ceiling portion of the cover 19 can be reinforced further accurately whereby deformation due to internal pressure and leakage of contents liquids can be prevented further accurately.

According to the aerosol device 10 for dispensing plural kinds of liquids, the propellant is filled in the aerosol container 11 and the inner bags 18, 18 which can vary capacity of contents liquid filled therein are connected to the pair of aerosol valves 15, 15. By this arrangement, two kinds of contents liquids can be dispensed and injected in the state in which contents liquids are separated from the inner bags and therefore contents liquids can be respectively injected without contacting the interior surface of the aerosol container 11.

In the aerosol device 10 for dispensing plural kinds of liquids, contents liquids are injected by attaching an actuator such as a push-button type actuator to the two stems. Two different contents liquids may be injected in a state separated from an actuator or, alternatively, may be injected after being mixed in an actuator. Such manner of injection may be selected depending upon the type of contents liquids and purpose of use of the contents liquids.

As contents liquids filled in the two inner bags of the aerosol device for dispensing plural kinds of liquids can be cited, for example, a main preparation and an additive of an aerosol product which are not suitable for pre-mixing for the reason that such pre-mixed product causes a chemical reaction such as hardening or oxidation. The aerosol device is suitable, for example, for hot shaving creams, hair dyes, adherents, coatings and pharmaceuticals. The aerosol device is also applicable to contents liquids of foam preparations.

The aerosol device for dispensing plural kinds of liquids is applicable not only to a case where two different contents liquids are dispensed and injected but also to a case where three or more kinds of contents liquids are dispensed and injected.

DESCRIPTION OF NUMERALS

10 aerosol device for dispensing plural kinds of contents liquids
11 aerosol container (inch can)
12 bead
13 mounting member
13*a* mounting member main body
13*b* flange portion
13*c* engaging projection
13*d* engaging portion
13*e* radial rib
13*f* top end projecting portion
13*g* seal point
14 valve housing mounting portion
14*a* engaging pawl
15 aerosol valve
15*a* stem
15*b* stem body
15*c* stem projecting portion
15*d* injection opening
15*e* orifice
15*f* spring
15*g* stem gasket
16 valve housing
16*a* engaging stepped portion
16*b* valve chamber
16*c* tube mounting portion
16*d* seal point
16*e* lower valve chamber
17 dip tube
18 inner bag
19 cover
20 seal gasket
21 poppet valve
22 flat side wall
23 curved side wall
30 reinforcing cover member
30*a* cover main body
30*b* bottom portion
31 holding means
31*a* slit
31*b* pawl
32 reinforcing cover member
33 reinforcing cover member

The invention claimed is:

1. An aerosol device for dispensing plural kinds of liquids comprising:

an aerosol container having an open head portion having an inner diameter of 1 inch and formed with a bead around the open head portion;

a plurality of aerosol valves, each having a valve housing and a stem, for injecting contents liquid outside through each stem;

a mounting member which has a plurality of valve housing mounting portions for mounting the valve housings, fittedly mounted on the open head portion of the container with a middle portion of the mounting member being located at the bead of the open head portion and having an outer diameter extending over at least a portion of the bead of the open head portion of the container;

a cover covering the outside of the mounting member, holding a stem gasket and being fixed on the outside of the bead through a seal gasket, said stems of the aerosol valves projecting outwardly through the cover;

a reinforcing cover member provided in a sandwich form between the mounting member and the cover for holding down the stem gasket and preventing deformation of the cover with an outer diameter that is less than the outer diameter of the mounting member; and a pair of the aerosol valves are provided, said mounting member comprising a substantially circular cylindrical main body portion and a top end projecting portion of a substantially elliptic cylinder shape having a pair of parallel flat side walls formed in the top portion of the mounting member, where the reinforcing cover member is provided in a manner to cover the top end projecting portion.

2. An aerosol device as defined in claim 1 further comprising an outward projection corresponding to a lateral groove provided between the reinforcing cover member and the mounting member wherein the outward projection engages the lateral groove to hold the reinforcing cover member to the mounting member.

3. An aerosol device as defined in claim 1 wherein the reinforcing cover member has, in addition to the portion covering the top end projecting portion, a portion which covers a bottom portion of the mounting member.

4. An aerosol device as defined in claim 1 or 2 wherein an aerosol propellant is filled in the aerosol container and an inner bag for varying capacity of contents liquid filled therein is connected to each of the aerosol valves.

5. An aerosol device as defined in claim 1 wherein an aerosol propellant is filled in the aerosol container and an inner bag for varying capacity of contents liquid filled therein is connected to each of the aerosol valves.

* * * * *